US009499891B2

(12) United States Patent
Wachter et al.

(10) Patent No.: US 9,499,891 B2
(45) Date of Patent: Nov. 22, 2016

(54) ZIRCONIUM-BASED ALLOY METALLIC GLASS AND METHOD FOR FORMING A ZIRCONIUM-BASED ALLOY METALLIC GLASS

(71) Applicants: Heraeus Materials Technology North America LLC, Chandler, AZ (US); Heraeus Materials Technology GmbH & Co. KG, Hanau (DE)

(72) Inventors: Hans Jürgen Wachter, Rödermark (DE); Frank Krüger, Nidderau (DE); Bernd Kunkel, Phoenix, AZ (US); Xiaoyun Wang, Phoenix, AZ (US); Doug Shearer, Tempe, AZ (US)

(73) Assignees: Heraeus Deutschland GmbH & Co. KG, Hanau (DE); Heraeus Materials Technology North America LLC, Chandler, AZ (US)

( * ) Notice: Subject to any disclaimer, the term of this patent is extended or adjusted under 35 U.S.C. 154(b) by 531 days.

(21) Appl. No.: 13/974,605

(22) Filed: Aug. 23, 2013

(65) Prior Publication Data

US 2015/0053313 A1 Feb. 26, 2015

(51) Int. Cl.

| | |
|---|---|
| ***C22C 45/10*** | (2006.01) |
| ***C22C 1/00*** | (2006.01) |
| ***C22C 1/02*** | (2006.01) |
| ***C22C 16/00*** | (2006.01) |

(52) U.S. Cl.

CPC ..... *C22C 45/10* (2013.01); *C22C 1/002* (2013.01); *C22C 1/02* (2013.01); *C22C 16/00* (2013.01); *C21D 2201/03* (2013.01)

(58) Field of Classification Search

None

See application file for complete search history.

(56) References Cited

U.S. PATENT DOCUMENTS

| | | | | |
|---|---|---|---|---|
| 5,288,344 | A | 2/1994 | Peker et al. | |
| 5,368,659 | A | 11/1994 | Peker et al. | |
| 5,735,975 | A | 4/1998 | Lin et al. | |
| 6,669,793 | B2 * | 12/2003 | Hays | B22F 3/006 148/403 |
| 6,771,490 | B2 * | 8/2004 | Peker | C22C 33/003 148/403 |
| 2004/0238077 | A1 | 12/2004 | Kuehn et al. | |

FOREIGN PATENT DOCUMENTS

| | | | |
|---|---|---|---|
| CN | 101580904 | A | 11/2009 |
| EP | 2597166 | A1 | 5/2013 |

OTHER PUBLICATIONS

Int'l Search Report and Written Opinion issued Nov. 7, 2014 in Int'l Application No. PCT/EP2014/067539.

Xiao et al, "Influence of beryllium on thermal stability and glass-forming ability of Zr—Al—Ni—Cu bulk amorphous alloys," Journal of Alloys and Compounds, vol. 376, pp. 145-148 (2004).

Hays et al, "Glass Forming Ability in the Zr—Nb—Ni—Cu—Al Bulk Metallic Glasses," Materials Science Forum, vols. 343-346, pp. 103-108 (2000).

Zhang et al, "Substituting effect of amorphous forming ability of multicomponent alloy with Be," Chinese Journal of Materials Research, vol. 17, No. 1, pp. 62-66 (Feb. 2003).

Zeng et al, "Influence of melt temperature on the compressive plasticity of a Zr—Cu—Ni—Al—Nb bulk metallic glass," J. Mater. Sci., vol. 46, pp. 951-956 (2011).

Lin et al, "Effect of Oxygen Impurity on Crystallization of an Undercooled Bulk Glass Forming Zr—Ti—Cu—Ni—Al Alloy," Materials Transactions, JIM, vol. 38, No. 5, pp. 473-477 (1997).

Sun et al, "Effect of Nb content on the microstructure and mechanical properties of Zr—Cu—Ni—Al—Nb glass forming alloys," Journal of Alloys and Compounds, vol. 403, pp. 239-244 (2005).

Evenson et al, "High temperature melt viscosity and fragile to strong transition in Zr—Cu—Ni—Al—Nb(Ti) and Cu47Ti34Zr11Ni8 bulk metallic glasses," Acta Materialia, vol. 60, pp. 4712-4719 (2012).

Szuecs et al, "Mechanical Properties of Zr56.2Ti13.8Nb5.0Cu6.9Ni5.6Be12.5 Ductile Phase Reinforced Bulk Metallic Glass Composite," Acta Mater., vol. 49, pp. 1507-1513 (2001).

Hays et al, "Improved mechanical behavior of bulk metallic glasses containing in situ formed ductile phase dendrite dispersions," Materials Science and Engineering, vol. A304-A306, pp. 650-655 (2001).

* cited by examiner

*Primary Examiner* — George Wyszomierski

(74) *Attorney, Agent, or Firm* — Panitch Schwarze Belisario & Nadel LLP

(57) ABSTRACT

A class of alloys is provided that form metallic glass upon cooling below the glass transition temperature Tg at a rate below 100° K/sec. The alloys have a high value of temperature difference (DT) between the crystallization temperature (Tx) and the glass transition temperature (Tg) of the intermetallic alloy. Such alloys comprise zirconium in the range of 70 to 80 weight percent, beryllium in the range of 0.8 to 5 weight percent, copper in the range of 1 to 15 weight percent, nickel in the range of 1 to 15 weight percent, aluminum in the range of 1 to 5 weight percent and niobium in the range of 0.5 to 3 weight percent, or narrower ranges depending on other alloying elements and the critical cooling rate and value of DT desired. Furthermore, methods are provided for making such metallic glasses.

15 Claims, No Drawings

ZIRCONIUM-BASED ALLOY METALLIC GLASS AND METHOD FOR FORMING A ZIRCONIUM-BASED ALLOY METALLIC GLASS

BACKGROUND OF THE INVENTION

This invention relates to amorphous metallic alloys, commonly referred to as metallic glasses, which are mostly formed by solidification of alloy melts by cooling the alloy to a temperature below its glass transition temperature before appreciable crystallization or nucleation of crystals can occur.

Metallic alloys having an amorphous or glassy phase are useful for several industrial applications. Normally, metals and intermetallic alloys crystallize during solidification from the liquid phase. Some metals and intermetallic alloys may be undercooled and remain as a viscous liquid phase or amorphous phase or glass at ambient temperatures when cooled rapidly. Typical cooling rates are about 1,000 to 1,000,000° K/sec.

To achieve rapid cooling rates of 10,000° K/sec or greater, a very thin layer (e.g., less than 100 micrometers) or small droplets of molten metal are brought into contact with a conductive substrate maintained at near ambient temperature. The small dimension of the amorphous material is a consequence of the need to extract heat at a sufficient rate to suppress crystallization. Thus, previously developed amorphous alloys have only been available as thin ribbons or sheets or as powders. Such ribbons, sheets or powders may be made by melt-spinning onto a cooled substrate, such as a spinning copper wheel, or by thin layer casting on a cooled substrate moving past a narrow nozzle.

Many efforts have been directed to searching for amorphous alloys with greater resistance to crystallization for achieving lower cooling rates and hence thicker metallic glasses, often also called bulk metallic glasses. The further crystallization may be suppressed at lower cooling rates, and thicker bodies of amorphous alloys may be obtained.

During formation of amorphous metallic alloys, undercooled alloy melt may crystallize. Crystallization occurs by a process of nucleation and growth of crystals driven by the energetically optimum structure and thereby setting the crystallization energy free. To form an amorphous solid intermetallic alloy, the melt has to be cooled from or above the melting temperature (Tm) to below the glass transition temperature (Tg), without the occurrence or with only minor occurrence of crystallization. Tx is the temperature at which crystallization occurs upon heating the amorphous alloy above the glass transition temperature. Crystallization of the metallic glass occurs at temperatures below crystallization temperature Tx but at a lower rate. The crystallization temperature Tx is not a sharply defined first order phase transition.

The metallic glasses are brought into the desired form by heating the metallic glass to a temperature above the glass transition temperature Tg and then forming the metallic glass. For forming the metallic glass, it is therefore desirable to find a system where the difference DT between the glass transition temperature Tg and the crystallization temperature Tx is substantial. A substantial difference in temperature DT allows the metallic glass to be formed without crystallization or, more precisely, without creating high amounts of unwanted crystalline phase in the metallic glass.

For bulk metallic glasses, it is therefore desirable to use an alloy having a substantial temperature difference (DT) between the crystallization temperature (Tx) and the glass transition temperature (Tg).

Intermetallic alloys that form bulk metallic glasses include zirconium-based alloys. One group of such Zr-based alloys is the Zr—Ti/Nb—Cu—Ni—Al alloys, which are known for example from X. H. Lin et al., "Effect of Oxygen Impurity on Crystallization of an Undercooled Bulk Glass Forming Zr—Ti—Cu—Ni—Al Alloy," *Materials Transactions*, Vol. 38, No. 5 (1997), pages 473 to 477; U.S. Pat. No. 5,735,975; U.S. Patent Application Publication 2004/238,077; European Patent Application Publication EP 2 597 166 A1; X. Zeng et al., "Influence of melt temperature on the compressive plasticity of a Zr—Cu—Ni—Al—Nb bulk metallic glass," *Journal of Materials Science* 46 (2011), pages 951-956; Z. Evenson et al., "High temperature melt viscosity and fragile to strong transition in Zr—Cu—Ni—Al—Nb(Ti) and $Cu_{47}Ti_{34}Zr_{11}Ni_8$ bulk metallic glasses," *Acta Materialia* 60 (2012), pages 4712 to 4719; Y. F. Sun et al., "Effect of Nb content on the microstructure and mechanical properties of Zr—Cu—Ni—Al—Nb glass forming alloys," *Journal of Alloys and Compounds* 403 (2005), pages 239-244.

Another group of Zr-base alloys forming bulk metallic glasses is the Zr—Ti—Nb—Cu—Ni—Be alloy known for example from C. Hays et al., "Improved mechanical behavior of bulk metallic glasses containing in situ formed ductile phase dendrite dispersions," *Materials Science and Engineering: A*, Volumes 304-306, (2001), pages 650-655; or F. Szuecs et al., "Mechanical properties of Zr56.2Ti13.8Nb5.0Cu6.9Ni5.6Be12.5 ductile phase reinforced bulk metallic glass composite," *Acta Materialia*, Volume 49, Issue 9, (2001), pages 1507-1513. A further group of Zr-based alloys forming bulk metallic glasses and bearing beryllium is Zr—Ti—Cu—Ni—Be, known from U.S. Pat. No. 5,288,344 and U.S. Pat. No. 5,368,659.

In some of the above mentioned systems, the temperature difference DT between the crystallization temperature Tx and the glass transition temperature Tg is less than 70° K, causing difficulties when forming these metallic glasses. A further drawback of some metallic glasses may be found in the difficulties to obtain the metallic glass from the melt. When the melting temperature Tm of the alloy is high compared to the glass transition temperature Tg, a higher amount of energy has to be extracted from the alloy to create the metallic glass. If the activation energy to form crystal nuclei in the alloy is low, seed crystals will form during the cooling of the alloy. Both problems may be encountered with a higher cooling rate. As thermal energy has to be conducted from the cooling metal alloy melt, a higher cooling rate results in unfavorably thinner metallic glass samples. The obtainable critical thickness of about 5 mm is still not sufficient for many technical applications, e.g., parts of clocks, springs, elastic contacts for electronic devices, etc.

BRIEF SUMMARY OF THE INVENTION

A task of this invention particularly is to overcome these problems. Even though some of the above mentioned metallic glasses show a rather high temperature difference DT of up to 100° K between the crystallization temperature Tx and the glass transition temperature Tg, there is the need and wish to get to even higher temperature differences DT to make thermoplastic forming of the bulk metallic glass even easier. Furthermore, it is desirable to find a mixture of chemical elements, wherein the melting temperature Tm is low and close to the glass transition temperature and wherein the activation energy to form crystal nuclei is as high as possible. It is a further task of the invention to obtain semifinished products having a thickness above 5 mm.

The invention provides a class of alloys that form metallic glass upon cooling to below the glass transition temperature Tg at a rate of 100° K/sec or lower and having a DT value of at least 70° K. Such alloys comprise zirconium in the range of 70 to 80 weight percent, beryllium in the range of 0.8 to 5 weight percent, copper in the range of 1 to 15 weight percent, nickel in the range of 1 to 15 weight percent, aluminum in the range of 1 to 5 weight percent, and niobium in the range of 0.5 to 3 weight percent, or narrower ranges depending on other alloying elements and the critical cooling rate and value of DT desired.

The compositions of the alloys may comprise inevitable trace impurities which are not considered. Other elements in the metallic glass are, preferably, less than two weight percent.

The composition of the intermetallic alloy according to the invention may be solidified with relatively low cooling rates of 100° K/sec or lower and create a metallic glass, which can easily be formed above the glass transition temperature Tg, because the crystallization temperature Tx is at least 70° K higher than the glass transition temperature Tg without creating more than 50% by volume (vol %) of crystalline phase in the metallic glass.

The mixtures of large atoms or ions, such as zirconium and niobium, medium sized atoms or ions, such as copper or nickel, and small atoms or ions, such as beryllium, prevent the melt from establishing a short range order easily. Therefore, the intermetallic alloys according to the invention have a higher activation potential to create crystal seeds or nuclei. Because of this, the intermetallic alloy may be cooled at lower cooling rates without formation of greater than 50 vol % crystalline phase and/or crystalline seeds in the metallic glass. This results in the possibility to prepare thicker samples of the intermetallic glass.

Aluminum binds oxygen from the melt, which otherwise serves as a seed for crystal formation. Therefore, the aluminum works as an oxygen getter, which further reduces the formation of crystalline phases in the metallic glass and thereby improves the obtainable thickness of the bulk metallic glass product.

These and other features and advantages of the invention will be appreciated as the same become better understood by reference to the following detailed description when considered in connection with the accompanying tables.

DETAILED DESCRIPTION OF THE INVENTION

The tasks of the invention are solved by a metallic glass formed of a zirconium-based alloy having about a Zr, b Be, c Cu, d Ni, e Al, and f Nb, where a, b, c, d, e, and f are weight percentages wherein:

a is in the range of 70 wt % to 80 wt %,
b is in the range of 0.8 wt % to 5 wt %,
c is in the range of 1 wt % to 15 wt %,
d is in the range of 1 wt % to 15 wt %,
e is in the range of 1 wt % to 5 wt %, and
f is in the range of 0.5 wt % to 3 wt %.

The tasks of the invention are also solved by a metallic glass formed of a zirconium-based alloy having about a Zr, b Be, c ($Cu_xNi_{1-x}$), e Al, and f Nb, where a, b, c, d, e, and f are weight percentages wherein:

a is in the range of 70 wt % to 80 wt %,
b is in the range of 0.8 wt % to 5 wt %,
c is in the range of 10 wt % to 25 wt %,
e is in the range of 1 wt % to 5 wt %,
f is in the range of 0.5 wt % to 3 wt %, and
x is an atomic fraction and in the range of 0.1 to 0.9.

In one embodiment of the invention, a is in the range of 74 wt % to 78 wt %. This composition range leads to the best results concerning DT.

More precisely, the tasks of the invention are solved by a metallic glass formed of a zirconium-based alloy having about a Zr, b Be, c Cu, d Ni, e Al, and f Nb, where a, b, c, d, e, and f are weight percentages wherein:

a is in the range of 74 wt % to 76 wt %,
b is in the range of 1 wt % to 3 wt %,
c is in the range of 9 wt % to 12 wt %,
d is in the range of 6 wt % to 8 wt %,
e is in the range of 2 wt % to 4 wt % and
f is in the range of 1 wt % to 2 wt %.

For all these metallic glass alloys, the temperature difference DT between the crystallization temperature Tx and the glass transition temperature Tg of the metallic glass is greater than 70° K, preferably greater than 100° K, and more preferably greater than 120° K.

Further, in one embodiment, a part of the Nb is substituted by Ti. In this case, the metallic glass has 0.5 wt % to 3 wt % ($Nb_yTi_{1-y}$), wherein y is an atomic fraction in the range of 0.1 to 1.

The tasks of the invention are also solved by a method for making a metallic glass product having at least 50 vol % amorphous phase comprising the steps of:

forming a melt of an alloy having the formula: a Zr, b Be, c Cu, d Ni, e Al, and f Nb, where a, b, c, d, e, and f are weight percentages wherein:

a is in the range of 70 wt % to 80 wt %,
b is in the range of 0.8 wt % to 5 wt %,
c is in the range of 6 wt % to 15 wt %,
d is in the range of 4 wt % to 10 wt %,
e is in the range of 1 wt % to 5 wt %, and
f is in the range of 1 wt % to 3 wt %, and cooling the melt to a temperature below its glass transition temperature at a sufficient cooling rate to prevent formation of more than 50 vol % crystalline phase in the product.

The tasks of the invention are further solved by a method for making a metallic glass product having at least 50 vol % amorphous phase comprising the steps of:

forming a melt of an alloy having the formula a Zr, b Be, c ($Cu_xNi_{1-x}$), e Al, and f Nb, where a, b, c, d, e, and f are weight percentages wherein:

a is in the range of 70 wt % to 80 wt %,
b is in the range of 0.8 wt % to 5 wt %,
c is in the range of 10 wt % to 25 wt %,
e is in the range of 1 wt % to 5 wt %,
f is in the range of 0.5 wt % to 3 wt %, and
x is an atomic fraction and in the range of 0.1 to 0.9, and cooling the melt to a temperature below its glass transition temperature at a sufficient cooling rate to prevent formation of more than 50 vol % crystalline phase in the product.

The tasks of the invention are also solved by a method for making a metallic glass product having at least 50 vol % amorphous phase comprising the steps of:

forming a melt of an alloy having the formula a Zr, b Be, c Cu, d Ni, e Al, and f Nb, where a, b, c, d, e, and f are weight percentages wherein:

a is in the range of 74 wt % to 76 wt %,
b is in the range of 1 wt % to 3 wt %,
c is in the range of 9 wt % to 12 wt %,
d is in the range of 6 wt % to 8 wt %,
e is in the range of 2 wt % to 4 wt %, and
f is in the range of 1 wt % to 2 wt %, and cooling the melt to a temperature below its glass transition temperature at a sufficient cooling rate to prevent formation of more than 50 vol % crystalline phase in the product.

In one embodiment of the method, the cooling rate is 100° K/sec or lower and preferably 10° K/sec or lower.

Additionally or alternatively, the thickness of the prepared metallic glass product may be between 8 mm and 20 mm.

The metallic glass is thermoplastically formed by heating the obtained metallic glass to above the glass transition temperature Tg but below the crystallization temperature Tx, forming the obtained metallic glass to a desired shape or product, and cooling the formed metallic glass to below the glass transition temperature Tg. It is preferred that the obtained metallic glass be heated to 1° K to 30° K above the glass transition temperature Tg prior to the thermoplastic forming.

For purposes of this invention, a metallic glass product is defined as a material that contains at least 50 vol % of the glassy or amorphous phase. To obtain the bulk metallic glasses of zirconium-based alloys at cooling rates of 100° K/sec or lower, the intermetallic melt is cast into cooled metal molds, preferably copper molds. As a result, rods or plates of up to 20 mm wall thickness are obtained. Alternatively, the melt may also be cast in silica or other glass containers.

A variety of new glass-forming intermetallic alloys have been identified to practice this invention. The ranges of alloys suitable for forming amorphous metal alloys may be defined in various ways. Some of the composition ranges are formed into metallic glasses with relatively higher cooling rates, whereas preferred compositions form metallic glasses with appreciably lower cooling rates.

The following is a table of alloys that can be cast as a rod at least ten millimeters thick, of which some have at least about 50 vol % amorphous phase. The exact quantity of the amorphous phase in the rod is difficult to measure. Hence, only three different quantities of amorphous phase in the sample rod are distinguished—about 100 vol % are of amorphous phase, at least about 50 vol % are of amorphous phase and no (0%) or clearly less than 50 vol % amorphous phase could be found in the amorphous phase of the sample rod. The amount of amorphous phase is determined by thermal analysis. The amount of amorphous phase may be calculated from the amount of exothermic energy when the complete amorphous phase is crystallized. The energy can be measured by differential scanning calorimetry (DSC) or differential thermal analysis (DTA). Furthermore or alternatively, the amount may be determined by a x-ray diffraction method or structural analysis.

| Be (wt %) | Al (wt %) | Cu (wt %) | Ni (wt %) | Nb (wt %) | Zr (wt %) | Amorphous phase (vol %) |
|---|---|---|---|---|---|---|
| 3.32 | 3.14 | 9.84 | 7.29 | 1.45 | 74.97 | 100% |
| 3.32 | 3.11 | 9.77 | 7.25 | 1.45 | 75.11 | 100% |
| 3.29 | 3.04 | 9.51 | 7.01 | 1.52 | 75.63 | 100% |
| 3.29 | 3.03 | 9.54 | 7.03 | 1.51 | 75.61 | 100% |
| 0.00 | 6.32 | 9.57 | 7.00 | 1.54 | 75.58 | 0% |
| 0.00 | 6.31 | 9.58 | 7.01 | 1.55 | 75.55 | 0% |
| 1.06 | 3.13 | 11.33 | 7.06 | 1.56 | 75.86 | 50% |
| 1.05 | 3.14 | 11.23 | 7.05 | 1.60 | 75.94 | 50% |
| 0.00 | 3.09 | 12.82 | 7.02 | 1.51 | 75.56 | 0% |
| 0.00 | 3.05 | 12.84 | 7.08 | 1.48 | 75.55 | 0% |
| 3.35 | 0 | 12.22 | 7.15 | 1.55 | 75.62 | 0% |
| 1.80 | 3.14 | 9.41 | 7.10 | 3.01 | 75.54 | 0% |
| 1.80 | 3.13 | 9.40 | 7.11 | 3.02 | 75.54 | 0% |

The values of Tg and Tx are measured by differential scanning calorimetry (DSC), but may also be determined by differential thermal analysis (DTA). A higher DT allows for a lower minimum cooling rate for obtaining an amorphous alloy and for a longer time available for processing (thermoplastic forming) the amorphous alloy above the glass transition temperature. A DT of more than 100° K indicates a particularly desirable glass-forming alloy.

The positively tested alloys have at least 50 vol % amorphous phase, and preferably about 100 vol % amorphous phase. The glass transition temperature Tg is about 380° C. while the crystallization temperature Tx is about 510° C. for the alloys with about 100 vol % amorphous phase. Therefore, DT is about 130° K or even slightly more, which is clearly greater than the DT of other zirconium-based metallic glasses known in the art.

A further advantage of the positively tested alloys is the thickness with which the metallic glass may be produced. The metallic glass containing at least 50 vol % or about 100 vol % amorphous phase may be produced with a thickness of up to 20 millimeters.

A number of specific examples of glass-forming alloy compositions having a wide temperature range of amorphous solidification are described herein. It will be apparent to those skilled in the art that the boundaries of these regions described are approximate, that compositions somewhat outside these precise boundaries may be good glass-forming materials, and that compositions slightly inside these boundaries may not be glass-forming materials at cooling rates that are too low. Thus, within the scope of the following claims, this invention may be practiced with some variation from the precise compositions described.

We claim:

1. A metallic glass formed of a zirconium-based alloy comprising a Zr, b Be, c Cu, d Ni, e Al, and f Nb, where a, b, c, d, e, and f are weight percentages wherein:

a is in a range of about 74 wt % to 76 wt %,
b is in a range of about 1 wt % to 3 wt %,
c is in a range of about 9 wt % to 12 wt %,
d is in a range of about 6 wt % to 8 wt %,
e is in a range of about 2 wt % to 4 wt %, and
f is in a range of about 1 wt % to 2 wt %.

2. The metallic glass as recited in claim 1, wherein a temperature difference DT between a crystallization temperature Tx and a glass transition temperature Tg of the metallic glass is greater than 100° K.

3. The metallic glass as recited in claim 1, wherein a temperature difference DT between a crystallization temperature Tx and a glass transition temperature Tg of the metallic glass is greater than 120° K.

4. The metallic glass as recited in claim 1, wherein a part of the Nb is substituted with Ti.

5. The metallic glass as recited in claim 4, wherein the metallic glass comprises 0.5 wt % to 3 wt % ($Nb_yTi_{1-y}$), wherein y is an atomic fraction in a range of 0.1 to 1.

6. A method for making a metallic glass product having at least 50 vol % amorphous phase comprising the steps of:

forming a melt of an alloy having the formula: a Zr, b Be, c Cu, d Ni, e Al, and f Nb, where a, b, c, d, e, and f are weight percentages wherein:

a is in a range of 74 wt % to 78 wt %,
b is in a range of 0.8 wt % to 5 wt %,
c is in a range of 6 wt % to 15 wt %,
d is in a range of 4 wt % to 10 wt %,
e is in a range of 1 wt % to 5 wt %, and
f is in a range of 1 wt % to 3 wt %, and cooling the melt to a temperature below its glass transition temperature at a sufficient cooling rate to prevent formation of more than 50 vol % crystalline phase in the product, wherein a thickness of the metallic glass product is between 8 mm and 20 mm.

7. The method as recited in claim 6, wherein the cooling rate is 100° K/sec or lower.

8. The method as recited in claim 6, wherein the cooling rate is 10° K/sec or lower.

9. A method for making a metallic glass product having at least 50 vol % amorphous phase comprising the steps of:

forming a melt of an alloy having the formula: a Zr, b Be, c ($Cu_xNi_{1-x}$), e Al and f Nb, where a, b, c, e, f, and x are weight percentages wherein:

a is in a range of 74 wt % to 78 wt %, b is in a range of 0.8 wt % to 5 wt %, c is in a range of 10 wt % to 25 wt %, e is in a range of 1 wt % to 5 wt %, f is in a range of 0.5 wt % to 3 wt %, and x is an atomic fraction in a range of 0.1 to 0.9, and cooling the melt to a temperature below its glass transition temperature at a sufficient cooling rate to prevent formation of more than 50 vol % crystalline phase in the product, wherein a thickness of the metallic glass product is between 8 mm and 20 mm.

10. The method as recited in claim 9, wherein the cooling rate is 100° K/sec or lower.

11. The method as recited in claim 9, wherein the cooling rate is 10° K/sec or lower.

12. A method for making a metallic glass product having at least 50 vol % amorphous phase comprising the steps of:

forming a melt of an alloy having the formula: a Zr, b Be, c Cu, d Ni, e Al, and f Nb, where a, b, c, d, e, and f are weight percentages wherein:

a is in the range of 74 wt % to 76 wt %, b is in a range of 1 wt % to 3 wt %, c is in a range of 9 wt % to 12 wt %, d is in a range of 6 wt % to 8 wt %, e is in a range of 2 wt % to 4 wt %, and f is in a range of 1 wt % to 2 wt %, and cooling the melt to a temperature below its glass transition temperature at a sufficient cooling rate to prevent formation of more than 50 vol % crystalline phase in the product.

13. The method as recited in claim 12, wherein the cooling rate is 100° K/sec or lower.

14. The method as recited in claim 12, wherein the cooling rate is 10° K/sec or lower.

15. The method as recited in claim 12, wherein a thickness of the metallic glass product is between 8 mm and 20 mm.

* * * * *